US012685915B2

(12) United States Patent
Frazier et al.

(10) Patent No.: US 12,685,915 B2
(45) Date of Patent: Jul. 21, 2026

(54) BACKSTOP NET SYSTEM

(71) Applicant: Soccer Park, LLC, Boise, ID (US)

(72) Inventors: Joshua Leland Frazier, Boise, ID (US); Justin Shook, Boise, ID (US)

(73) Assignee: Soccer Park, LLC, Boise, ID (US)

( * ) Notice: Subject to any disclaimer, the term of this patent is extended or adjusted under 35 U.S.C. 154(b) by 662 days.

(21) Appl. No.: 18/118,894

(22) Filed: Mar. 8, 2023

(65) Prior Publication Data

US 2024/0299827 A1 Sep. 12, 2024

(51) Int. Cl.
*A63B 71/02* (2006.01)
*A63B 63/00* (2006.01)

(52) U.S. Cl.
CPC ..... *A63B 71/022* (2013.01); *A63B 63/004* (2013.01); *A63B 71/023* (2013.01); *A63B 2225/093* (2013.01); *A63B 2243/0025* (2013.01)

(58) Field of Classification Search
CPC ... A63B 71/022; A63B 63/004; A63B 71/023; A63B 2225/093; A63B 2243/0025; A63C 2019/085; E04H 3/14
See application file for complete search history.

(56) References Cited

U.S. PATENT DOCUMENTS

| | | | | |
|---|---|---|---|---|
| 4,078,795 | A * | 3/1978 | Porter | E04H 3/14 256/27 |
| 5,577,721 | A * | 11/1996 | Hardee | A63B 71/022 473/421 |
| 9,295,899 | B1 * | 3/2016 | Dixon, Jr. | A63B 71/02 |
| 2019/0192948 | A1 * | 6/2019 | Deal | A63B 1/00 |
| 2021/0046372 | A1 * | 2/2021 | Frazier | A63B 71/023 |
| 2021/0220715 | A1 * | 7/2021 | Colding | A63B 71/03 |
| 2022/0062726 | A1 * | 3/2022 | Kapsalis | A63B 71/022 |

* cited by examiner

*Primary Examiner* — Michael D Dennis
(74) *Attorney, Agent, or Firm* — Parsons Behle & Latimer

(57) ABSTRACT

A field may include a plurality of walls segments, stanchions, one or more goals, and one or more doors. A net may encompass at least a portion of a perimeter of a playing field of the field. The net may include a roof portion. An end of the roof portion includes a first end adjacent a base line and a second end a distance into the playing field. The second end of the roof portion is attached to two stanchions. A cable is attached between a winch it attached to the end of a main support pole of the two stanchions connected to the second end of the roof portion. The winch applies a force to the end of the main poles to prevent the main poles from bending inwards towards the playing field.

13 Claims, 3 Drawing Sheets

BACKSTOP NET SYSTEM

FIELD OF THE DISCLOSURE

The embodiments described herein relate to apparatuses, systems, and methods for a backstop net system for a modular field. The field may be, but is not limited to, a soccer field.

BACKGROUND

Description of the Related Art

It may be important to have local sporting fields to permit individuals to exercise, engage in sporting contests, and/or engage in various outdoor activities. In some locales, adequate space may not be available for a sporting field. In other areas, there may not be the resources to take care of a grass field. Some areas may have a space available that is smaller than a standard size for a typical sporting fields, such as a soccer field. A modular field may be used provided for playing in such locales. The modular field may include a net to help prevent a playing ball from leaving the playing field. Roof portions of the net may sag inwards towards the playing field. Sagging roof portions of the net may reduce the distance from which a player may be able to shoot on goal. Other disadvantages may exist.

SUMMARY

The present disclosure is directed to apparatuses, systems, and methods for a backstop net system for a modular field that overcomes at least one of the disadvantages discussed above. The field may be, but is not limited to, a soccer field.

An embodiment of the present disclosure is a system. The system includes a plurality of wall segments. The system includes a plurality of stanchions. Each stanchion of the plurality of stanchions includes a main support pole. A height of the main support pole of the stanchions may be varied. The stanchions connect together two adjacent wall segments that are coplanar. The system includes a plurality of corner stanchions. Each corner stanchion includes a main support pole. A height of the main support pole of the corner stanchions may be varied. The corner stanchions connect together two adjacent wall segments that are oriented perpendicular to each other.

The system includes a first goal. The first goal being connected between to two adjacent wall segments by two of the plurality of stanchions. The system includes a second goal. The second goal being connected between to two adjacent wall segments by two of the plurality of stanchions. The system includes one or more doors. The door is connected to adjacent wall segments by two of the plurality of stanchions. The plurality of wall segments, the plurality of stanchions, the plurality of corner stanchions, the first goal, the second goal, and the one or more doors define a perimeter of a playing field. The first goal is located at a first end line of the playing field. The second goal is located at a second end line of the playing field.

The system includes a net that encompasses at least a portion of the perimeter of the playing field. The net is secured to the plurality of stanchions and the plurality of corner stanchions. The net includes a first roof portion. The first roof portion includes a first end of the first roof portion located substantially parallel with the first end line. The first roof portion includes a second end of the first roof portion located a first distance into playing field from the first end line. The second end of the first roof portion is connected to a first stanchion of the plurality of stanchions and the second end of the first roof portion is connected to a second stanchion of the plurality of stanchions.

The system includes a first winch and a first line connected between the first winch to an end of the main support pole of the first stanchion. The first winch applies an outward force, with respect to the playing field, on the end of the main support pole of the first stanchion by shortening a length of the first line between the first winch and the end of the main support pole of the first stanchion. The system includes a second winch and a second line connected between the second winch to an end of the main support pole of the second stanchion, wherein the second winch applies an outward force, with respect to the playing field, on the end of the main support pole of the second stanchion by shortening a length of the second line between the second winch and the end of the main support pole of the second stanchion.

The first winch and the second winch may be configured to remove slack from the second end of the first roof portion by shortening the lengths of the first line and the second line. The first winch may be connected to the first stanchion and the second winch may be connected to the second stanchion. The net may encompass the entire perimeter of the playing field.

The net may include a second roof portion. The second roof portion may include a first end located substantially parallel with the second end line and the second roof portion may include a second end located the first distance into playing field from the second end line. The second end of the second roof portion may be connected to a third stanchion of the plurality of stanchions and the second end of the second roof portion may be connected to a fourth stanchion of the plurality of stanchions.

The system may include a third winch and a third line connected between the third winch to an end of the main support pole of the third stanchion. The third winch may apply an outward force, with respect to the playing field, on the end of the main support pole of the third stanchion by shortening a length of the third line between the third winch and the end of the main support pole of the third stanchion. The system may include a fourth winch and a fourth line connected between the fourth winch to an end of the main support pole of the fourth stanchion. The fourth winch may apply an outward force, with respect to the playing field, on the end of the main support pole of the fourth stanchion by shortening a length of the fourth line between the fourth winch and the end of the main support pole of the fourth stanchion. The third winch and the fourth winch may be configured to remove slack from the second end of the second roof portion by shortening the lengths of the third line and the fourth line. The third winch may be connected to the third stanchion and the fourth winch may be connected to the fourth stanchion.

Each stanchion of the plurality of stanchions may include a base plate connected to the main support port. The first winch may be connected to the base plate of the first stanchion and the second winch may be connected to the base plate of the second stanchion. Each stanchion of the plurality of stanchions may include a channel receptacle connected to the base plate, a rear plate connected to the main support pole, a frame connected to the rear plate, a front plate, and a clamp connected to the main support pole. Each corner stanchion of the plurality of corner stanchions may include a base plate, the base plate having a first channel receptacle and a second channel receptacle, the main support pole being connected to the base plate, a first rear plate connected to the main support pole, a second rear plate connected to the main support pole, a first front plate, and a second front plate. Other embodiments also exist.

Figure 1:
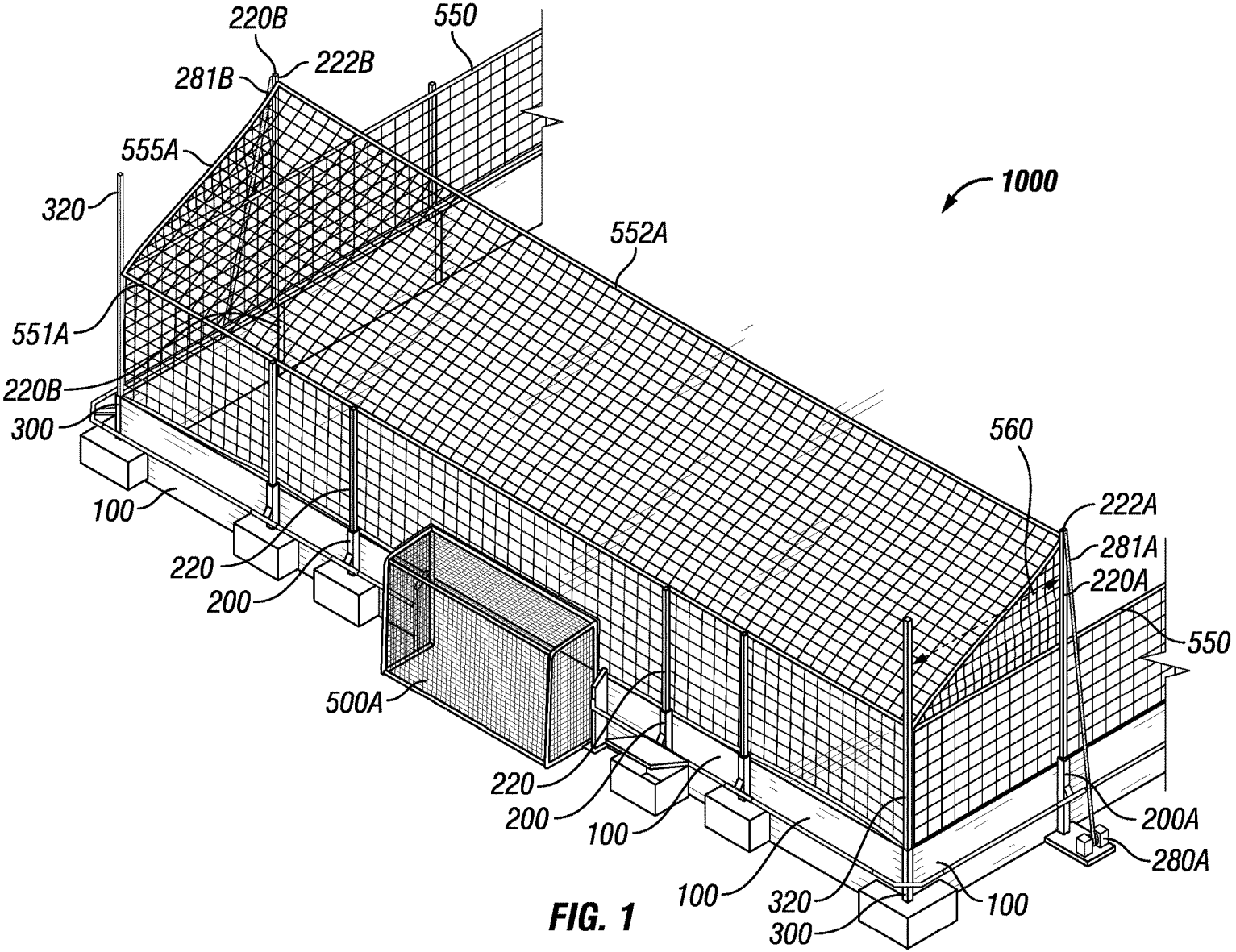
FIG. 1 shows a portion of an embodiment of a field.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
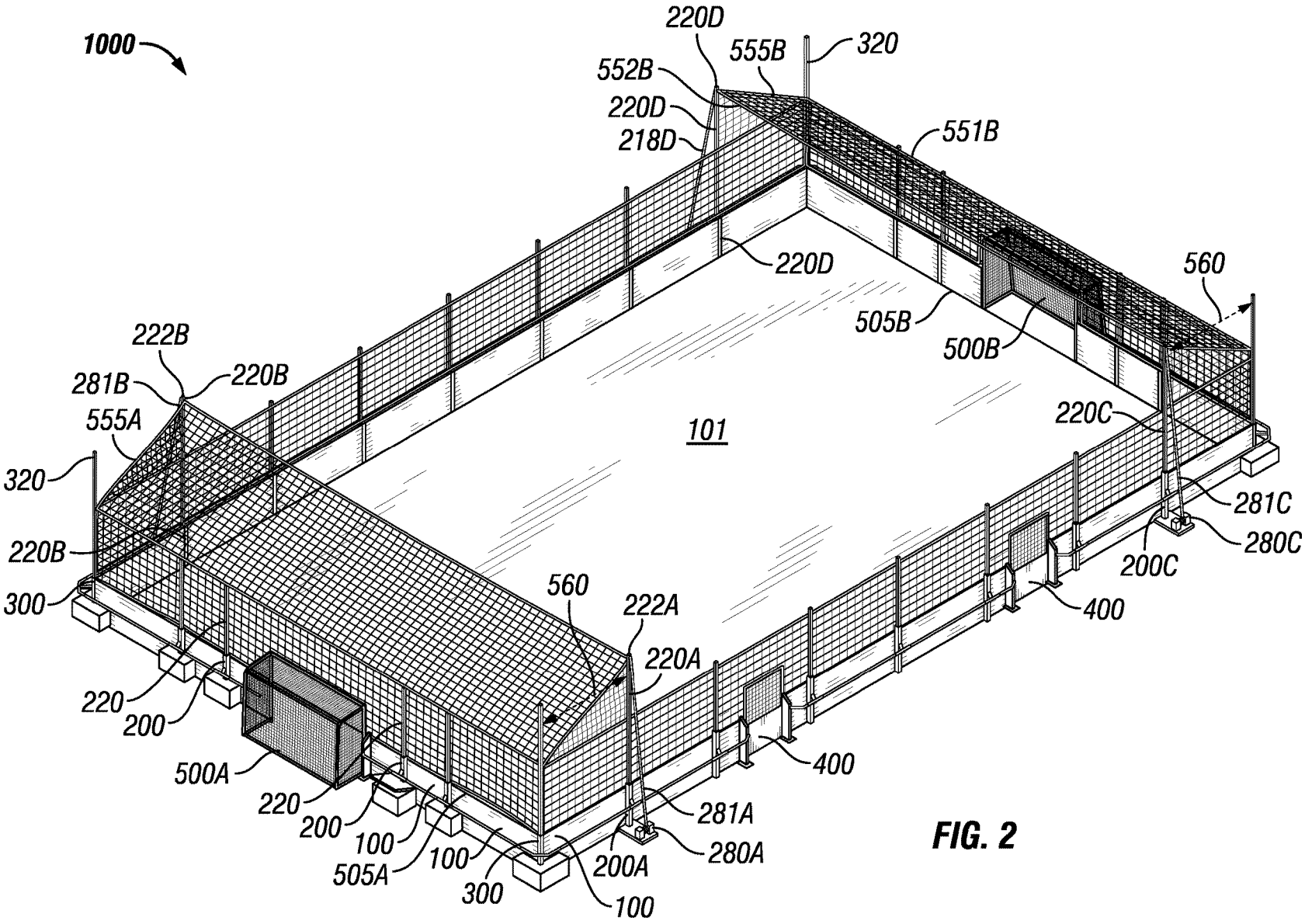
FIG. 2 shows an embodiment of a field.

FIG. 1 shows a portion of an embodiment of a field 1000 and FIG. 2 shows an embodiment of a field 1000 that includes a playing surface or playing field 101. The field 1000 may include all, or some of, the components of the field disclosed in U.S. Patent Application Publication No. 2021/0046372 entitled "MODULAR FIELD", which is incorporated by reference herein in its entirety.

The field 1000 includes a plurality of wall segments 100. The plurality of wall segments 100 are connected together by a plurality of stanchions 200. Each stanchion 200 of the plurality of stanchions 200 includes a main support pole 220. A height of the main support pole 220 of the stanchions 200 may be varied. The stanchions 200 may connect together two adjacent wall segments 100 that are coplanar. The stanchions 200 may also connect a goal 500 to an adjacent wall segment 100. The field 1000 includes a plurality of corner stanchions 300. Each corner stanchion 300 includes a main support pole 320. A height of the main support pole 320 of the corner stanchions 300 may be varied. The corner stanchions 320 connect together two adjacent wall segments 100 that are oriented perpendicular to each other.

The field 1000 includes a first goal 500A. The first goal 500A being connected between to two adjacent wall segments 100 by two of the plurality of stanchions 200. The field 1000 includes a second goal 500B. The second goal 500B being connected between to two adjacent wall segments 100 by two of the plurality of stanchions 200. The field 1000 includes one or more doors 400. The door 400 is connected to adjacent wall segments 100 by two of the plurality of stanchions 200. The plurality of wall segments 100, the plurality of stanchions 200, the plurality of corner stanchions 300, the first goal 500A, the second goal 500B, and the one or more doors 400 define a perimeter of the playing field 101 of the field 1000 as shown in FIG. 2. The first goal 500A is located at a first end line 505A of the playing field 101. The second goal 500B is located at a second end line 505B of the playing field 101.

The field 1000 includes a net 550 that encompasses at least a portion of the perimeter of the playing field 101. The net 500 is secured to the plurality of stanchions 200 and the plurality of corner stanchions 300. The net 500 includes a first roof portion 555A. The first roof portion 555A includes a first end 551A of the first roof portion 555A located substantially parallel with the first end line 505A. The first roof portion 555A includes a second end 552A of the first roof portion 555A located a first distance 560 into playing field (e.g., playing surface) 101 from the first end line 505A. The second end 552A of the first roof portion 555A is connected to a first stanchion 200A of the plurality of stanchions 200 and the second end 552A of the first roof portion 555A is connected to a second stanchion 200B of the plurality of stanchions 200.

The field 1000 includes a first winch 280A and a first line 281A connected between the first winch 280A and an end 222A of the main support pole 220A of the first stanchion 200A. The first winch 280A applies an outward force, with respect to the playing field 101, on the end 222A of the main support pole 220A of the first stanchion 220A by shortening a length of the first line 281A between the first winch 280A and the end 222A of the main support pole 220A of the first stanchion 200A. The field 1000 includes a second winch (not shown) and a second line 281B connected between the second winch and an end 222B of the main support pole 220B of the second stanchion 220B, wherein the second winch applies an outward force, with respect to the playing field 101, on the end 222B of the main support pole 220B of the second stanchion 200B by shortening a length of the second line 281B between the second winch and the end 222B of the main support pole 220B of the second stanchion 200B.

The first winch 280A and the second winch may be configured to remove slack from the second end 552A of the first roof portion 555A by shortening the lengths of the first line 281A and the second line 281B. The first winch 280A may be connected to the first stanchion 200A and the second winch may be connected to the second stanchion 200B. The net 550 may encompass the entire perimeter of the playing field 101.

The net 550 may include a second roof portion 555B. The second roof portion 555B may include a first end 551B located substantially parallel with the second end line 505B and the second roof portion 555B may include a second end 552B located the first distance 560 into playing field 101 from the second end line 505B. The second end 552B of the second roof portion 555B may be connected to a third stanchion 200C of the plurality of stanchions 200 and the second end 552B of the second roof portion 555B may be connected to a fourth stanchion 200D of the plurality of stanchions 200.

The field, or system, 1000 may include a third winch 280C and a third line 281C connected between the third winch 280C and an end 222C of the main support pole 220C of the third stanchion 200C. The third winch 280C may apply an outward force, with respect to the playing field 100, on the end 222C of the main support pole 220C of the third stanchion 200C by shortening a length of the third line 281C between the third winch 280C and the end 222C of the main support pole 220C of the third stanchion 200C. The field 1000 may include a fourth winch (not shown) and a fourth line 281D connected between the fourth winch and an end 222D of the main support pole 220D of the fourth stanchion 200D. The fourth winch may apply an outward force, with respect to the playing field 101, on the end 222D of the main support pole 220D of the fourth stanchion 200D by shortening a length of the fourth line 281D between the fourth winch and the end 222D of the main support pole 220D of the fourth stanchion 200D. The third winch 280C and the fourth winch may be configured to remove slack from the second end 552B of the second roof portion 555B by shortening the lengths of the third line 281C and the fourth line 282C. The third winch 280C may be connected to the third stanchion 220C and the fourth winch may be connected to the fourth stanchion 200C.

Figure 3:
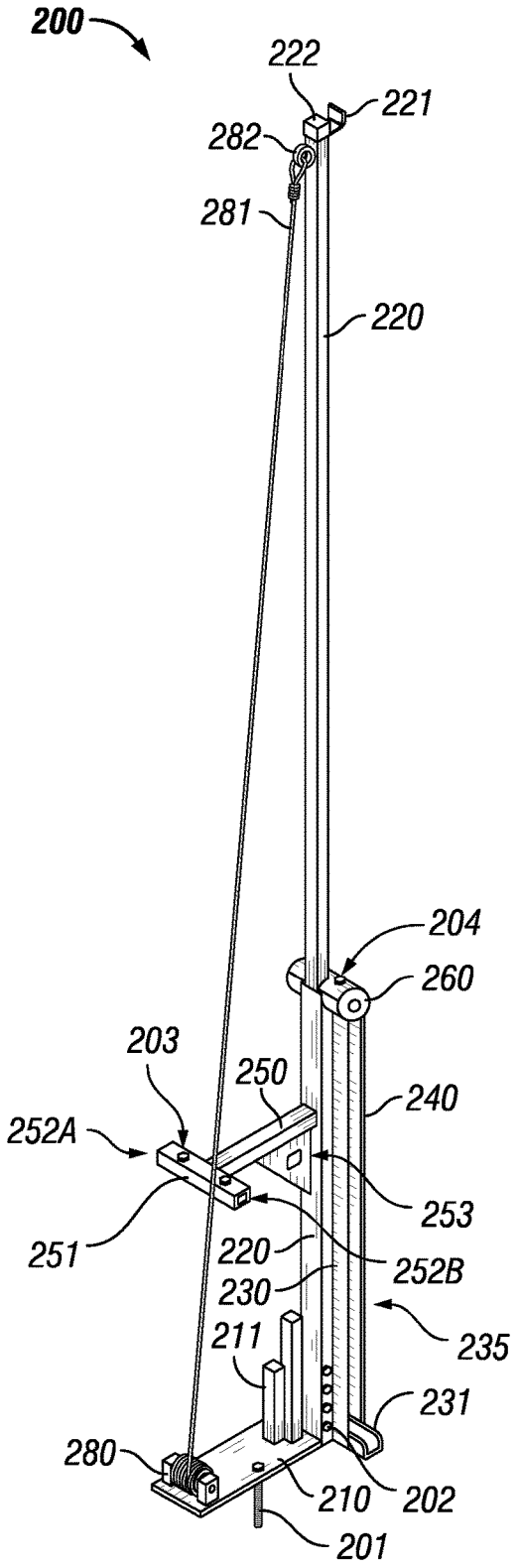
FIG. 3 shows an embodiment of a stanchion with a line connected to the top of the stanchion to a winch.

FIG. 3 shows a perspective view schematic of an embodiment of a stanchion 200 that includes a winch 280 connected to the stanchion 200. The stanchion 200 includes a base plate 210 that is used to support the stanchion 200 on the ground or other supporting surface. One or more fasteners 201 may optionally fasten the base plate 210 to the ground or other support surface. The winch 280 may be connected to the base plate 210. A main support pole 220 is connected to the base plate 210 and extends substantially perpendicular, or vertical, with respect to the base plate 210. A line, or cable, 281 is connected between the winch 280 and an end 222 of the main support pole 220. The line 281 may be connected to a fixture 282 connected to the main support pole 220 adjacent to the end 222.

The main support pole 220 may be connected to the base plate 210 via various mechanisms as would be appreciated by one of ordinary skill in the art. For example, the main support pole 220 may be connected to a projection on the base plate 210 by a plurality of fasteners 202, which enable the height of the main support pole 220 in reference to the base plate 210 to be adjusted. In other words, the main support pole 220 may include a telescopic height adjustment with reference to the base plate 210. The main support pole 220 and corresponding portion of the base plate 210 may include national pipe thread (NPT) taper holes. The NPT holes may be tapered so that they get tighter and tighter the deeper a fastener is threaded into the hole. The use of tapered threaded holes may be able to be used to adjust the height of the main support pole 220 of the stanchion 200 in case the ground or support surface is not perfectly level. Various other types of fasteners may be used, such as, but not limited to, spring buttons, thumb knobs, a threaded rod, or the like.

The base plate 210 of the stanchion 200 may include an accessory rod 211 that extends substantially perpendicular, or vertical from, the base plate 210. The accessory rod 211 enables the connection of various accessories to the base plate 210 of the stanchion 200. For example, the accessory may be, but is not limited to, a bench, a planter, a storage bin, a corner planter, or the like.

The stanchion 200 may include a secondary pole 250 that extends substantially perpendicular, or horizontal, from the main support pole 220. A connector 251 may be connected to the end of the secondary pole 250 and the connector 251 includes a first opening 252A and a second opening 252B configured to connect the secondary pole 250 to another component, such as a handrail. Fasteners 203 may be used to secure a handrail to the connector 251. The stanchion 200 may include a support 253 connected between the main support pole 220 and the secondary pole 250. The main support pole 220 may include a hook 221, or other connector, located at or near the top of the main support pole 220. The hook 221, or the like, may be used to support electrical wires, support wires, a net, or the like as would be appreciated by one of ordinary skill in the art having the benefit of this disclosure.

The stanchion 200 includes a back plate 230 connected to the main support pole 220. The stanchion 200 also includes a wall receptacle 231, a front plate 240, and a clamp 260. The stanchion 200 is configured to capture two adjacent wall segments 100 that are aligned with each other. The stanchion 200 includes a gap 235 (best shown in FIG. 3) between the back plate 230 and the front plate 240. The gap 235 is configured to receive the edges of two adjacent wall segments 100. The adjacent wall segments are captured between the back plate 230 and the front plate 240 and the between the wall receptacle 231 and the clamp 260. The stanchion 200 includes a frame connected to the main support pole 220 between the back plate 230 and the front plate 240. The frame is configured to close the gap between two adjacent wall segments 100 captured by the components of the stanchion 200. The frame may have a rectangular cross-section. Stanchions 200 may also be used to connect a door 400 to adjacent wall segments 100 or a goal 500A, 500B to adjacent wall segments 100.

The receptacle 231 of the stanchion 200 is configured to engage the bottom edge of a wall segment 100 that is positioned within the gap 235 between the rear plate 230 and the front plate 240. The front plate 240 is removable and may be secured to the frame via a plurality of fasteners. The clamp 260 is also removable and may be secured to the main support pole 220 and the frame via a plurality of fasteners 204. The front plate 240 and clamp 260 may be removed to enable two wall segments 100 to be positioned within the receptacle 231 to abut against frame 270. The clamp 260 and front plate 240 may then be secured to the frame 270 and main support pole 220 to capture the two adjacent wall segments 100 to form a wall of the modular field 1000 as shown in FIG. 7

Figure 4:
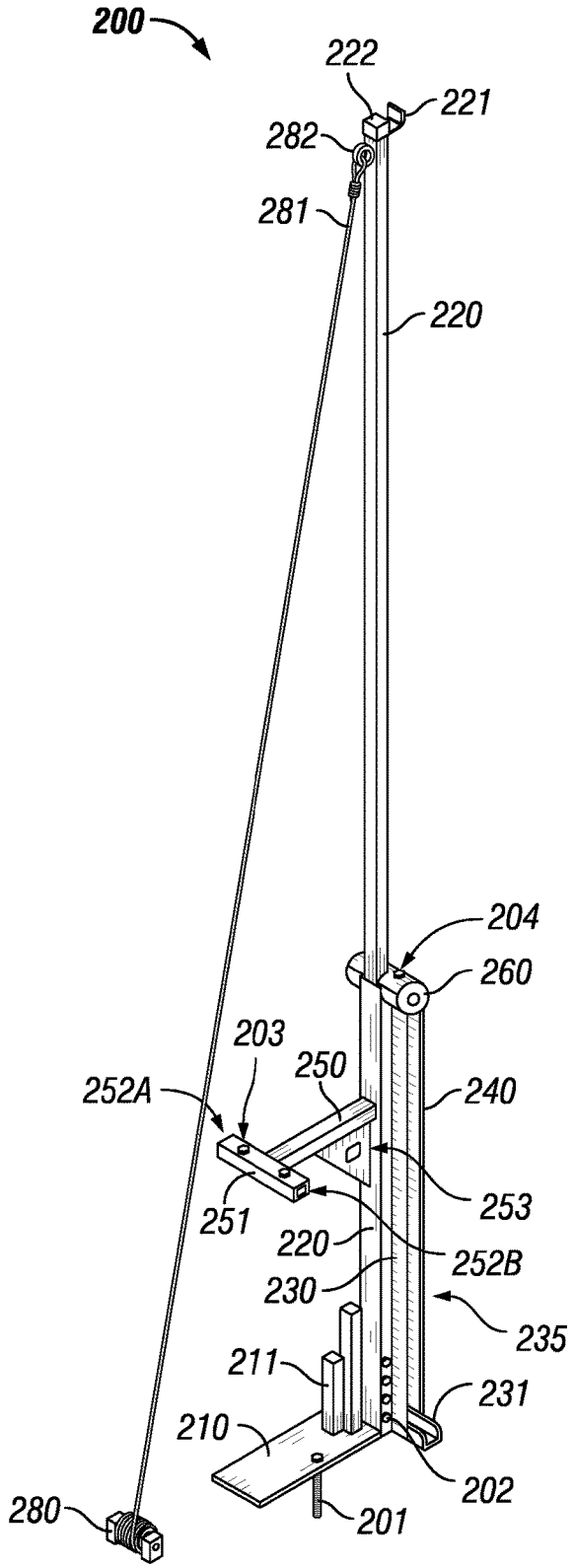
FIG. 4 shows an embodiment of a stanchion with a line connected to the top of the stanchion to a winch.

FIG. 4 shows a perspective view schematic of an embodiment of a stanchion 200 that includes a winch 280 that is connected to a structure or surface other than the base plate 210 of the stanchion 200.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A system comprising:

a plurality of wall segments;

a plurality of stanchions, each stanchion of the plurality of stanchions including a main support pole, wherein a height of the main support pole of the plurality of stanchions may be varied and wherein the stanchions connect together two adjacent wall segments that are coplanar;

a plurality of corner stanchions, each corner stanchion having a main support pole, wherein a height of the main support pole of the plurality of corner stanchions may be varied and wherein the corner stanchions connect together two adjacent wall segments that are oriented perpendicular to each other;

a first goal; the first goal being connected to two adjacent wall segments by two of the plurality of stanchions;

a second goal; the second goal being connected to two adjacent wall segments by two of the plurality of stanchions;

one or more doors, the one or more door connected to adjacent wall segments by two of the plurality of stanchions, wherein the plurality of wall segments, plurality of stanchions, plurality of corner stanchions, the first goal, the second goal, and the one or more doors define a perimeter of a playing field;

wherein the first goal is located at a first end line of the playing field;

wherein the second goal is located at a second end line of the playing field;

a net that encompasses at least a portion of the perimeter of the playing field, the net being secured to the plurality of stanchions and the plurality of corner stanchions;

the net comprises a first roof portion, the first roof portion includes a first end of the first roof portion located substantially parallel with the first end line and includes a second end of the first roof portion located a first distance into playing field from the first end line;

wherein the second end of the first roof portion is connected to a first stanchion of the plurality of stanchions and wherein the second end of the first roof portion is connected to a second stanchion of the plurality of stanchions;

a first winch;

a first line connected between the first winch to an end of the main support pole of the first stanchion, wherein the first winch applies an outward force, with respect to the playing field, on the end of the main support pole of the first stanchion by shortening a length of the first line between the first winch and the end of the main support pole of the first stanchion;

a second winch; and a second line connected between the second winch to an end of the main support pole of the second stanchion, wherein the second winch applies an outward force, with respect to the playing field, on the end of the main support pole of the second stanchion by shortening a length of the second line between the second winch and the end of the main support pole of the second stanchion.

2. The system of claim 1, wherein the first winch and second winch are configured to remove slack from the second end of the first roof portion by shortening the lengths of the first line and the second line.

3. The system of claim 2, wherein the first winch is connected to the first stanchion and wherein the second winch is connected to the second stanchion.

4. The system of claim 3, wherein the net encompasses the entire perimeter of the playing field.

5. The system of claim 4, wherein the net further comprises a second roof portion.

6. The system of claim 5, the second roof portion includes a first end located substantially parallel with the second end line and includes a second end located the first distance into playing field from the second end line, wherein the second end of the second roof portion is connected to a third stanchion of the plurality of stanchions and wherein the second end of the second roof portion is connected to a fourth stanchion of the plurality of stanchions.

7. The system of claim 6, further comprising:

a third winch;

a third line connected between the third winch to an end of the main support pole of the third stanchion, wherein the third winch applies an outward force, with respect to the playing field, on the end of the main support pole of the third stanchion by shortening a length of the third line between the third winch and the end of the main support pole of the third stanchion;

a fourth winch; and a fourth line connected between the fourth winch to an end of the main support pole of the fourth stanchion, wherein the fourth winch applies an outward force, with respect to the playing field, on the end of the main support pole of the fourth stanchion by shortening a length of the fourth line between the fourth winch and the end of the main support pole of the fourth stanchion.

8. The system of claim 7, wherein the third winch and the fourth winch are configured to remove slack from the second end of the second roof portion by shortening the lengths of the third line and the fourth line.

9. The system of claim 8, wherein the third winch is connected to the third stanchion and wherein the fourth winch is connected to the fourth stanchion.

10. The system of claim 1, wherein each stanchion of the plurality of stanchions further include a base plate connected to the main support port.

11. The system of claim 10, wherein the first winch is connected to the base plate of the first stanchion and wherein the second winch is connected to the base plate of the second stanchion.

12. The system of claim 11, wherein each stanchion of the plurality of stanchions further include a channel receptacle connected to the base plate, a rear plate connected to the main support pole, a frame connected to the rear plate, a front plate, and a clamp connected to the main support pole.

13. The system of claim 12, wherein each corner stanchion of the plurality of corner stanchions further includes a base plate, the base plate having a first channel receptacle and a second channel receptacle, the main support pole being connected to the base plate, a first rear plate connected to the main support pole, a second rear plate connected to the main support pole, a first front plate, and a second front plate.

* * * * *